US007364691B2

(12) United States Patent
Barker et al.

(10) Patent No.: US 7,364,691 B2
(45) Date of Patent: Apr. 29, 2008

(54) METALLURGICAL VESSEL

(75) Inventors: Ian James Barker, White Gum Gully (AU); Stephen John Poole, Winthrop (AU)

(73) Assignee: Technological Resources Pty. Limited, Victoria (AU)

( * ) Notice: Subject to any disclaimer, the term of this patent is extended or adjusted under 35 U.S.C. 154(b) by 122 days.

(21) Appl. No.: 11/142,230

(22) Filed: Jun. 2, 2005

(65) Prior Publication Data

US 2006/0022388 A1 Feb. 2, 2006

(30) Foreign Application Priority Data

Jun. 8, 2004 (AU) ..... 2004903122
Apr. 26, 2005 (AU) ..... 2005902097

(51) Int. Cl.
*C21B 3/00* (2006.01)

(52) U.S. Cl. ..... 266/275; 266/242

(58) Field of Classification Search ..... 266/275, 266/242

See application file for complete search history.

(56) References Cited

U.S. PATENT DOCUMENTS 4,575,394 A * 3/1986 Nixon ..... 75/414
6,267,799 B1 7/2001 Innes et al.
6,322,745 B1 11/2001 Leigh et al.
6,565,798 B2 5/2003 Gurr et al.

FOREIGN PATENT DOCUMENTS

WO WO-96/31627 10/1996
WO WO-00/01854 1/2000

* cited by examiner

*Primary Examiner*—Scott Kastler
(74) *Attorney, Agent, or Firm*—Finnegan, Henderson, Farabow, Garrett and Dunner, L.L.P.

(57) ABSTRACT

A metallurgical vessel having a cylindrical upper end section and a top section fitted to the upper end of another section to form a top closure of the vessel about a central opening through which to extend a gas injection lance for injecting gas into the vessel. Top section is formed as a two-part domed construction comprising an outer annular panel welded to the vessel top section and an inner annular panel removably fastened to outer panel, both panels being formed with inwardly concave curvature so as to form together the continuously domed top section. The two panels are fastened together by clamping bolts extended through outturned flanges formed on annular flanges standing up from the panels. On release of bolts panel is removable to provide access to the interior of the vessel.

25 Claims, 11 Drawing Sheets

METALLURGICAL VESSEL

TECHNICAL FIELD

The present invention relates to metallurgical vessels within which to carry out metallurgical processes. The invention has particular but not exclusive application to metallurgical vessels within which to perform direct smelting to produce molten metal in pure or alloy form from a metalliferous feed material such as ores, partly reduced ores and metal-containing waste streams.

A known direct smelting process, which relies principally on a molten metal layer as a reaction medium, and is generally referred to as the HIsmelt process, is described in U.S. Pat. No. 6,267,799 and International Patent Publication WO 96/31627 in the name of the applicant. The HIsmelt process as described in these publications comprises:

(a) forming a bath of molten iron and slag in a vessel;

(b) injecting into the bath:

(i) a metalliferous feed material, typically metal oxides; and (ii) a solid carbonaceous material, typically coal, which acts as a reductant of the metal oxides and a source of energy; and (c) smelting metalliferous feed material to metal in the metal layer.

The term "smelting" is herein understood to mean thermal processing wherein chemical reactions that reduce metal oxides take place to produce liquid metal.

The HIsmelt process also comprises post-combusting reaction gases, such as CO and $H_2$ released from the bath, in the space above the bath with oxygen-containing gas and transferring the heat generated by the post-combustion to the bath to contribute to the thermal energy required to smelt the metalliferous feed materials.

The HIsmelt process also comprises forming a transition zone above the nominal quiescent surface of the bath in which there is a favourable mass of ascending and thereafter descending droplets or splashes or streams of molten metal and/or slag which provide an effective medium to transfer to the bath the thermal energy generated by post-combusting reaction gases above the bath.

In the HIsmelt process the metalliferous feed material and solid carbonaceous material is injected into the metal layer through a number of lances/tuyeres which are inclined to the vertical so as to extend downwardly and inwardly through the side wall of the smelting vessel and into the lower region of the vessel so as to deliver the solids material into the metal layer in the bottom of the vessel. To promote the post combustion of reaction gases in the upper part of the vessel, a blast of hot air, which may be oxygen enriched, is injected into the upper region of the vessel through the downwardly extending hot air injection lance. Offgases resulting from the post-combustion of reaction gases in the vessel are taken away from the upper part of the vessel through an offgas duct.

The HIsmelt process enables large quantities of molten metal to be produced by direct smelting in a single compact vessel. This vessel must function as a pressure vessel containing solids, liquids and gases at very high temperatures throughout a smelting operation which can be extended over a long period. As described in U.S. Pat. No. 6,322,745 and International Patent Publication WO 00/01854 in the name of the applicant the vessel may consist of a steel shell with a hearth contained therein formed of refractory material having a base and sides in contact with at least the molten metal and side walls extending upwardly from the sides of the hearth that are in contact with the slag layer and the gas continuous space above, with at least part of those side walls consisting of water cooled panels. Such panels may be of a double serpentine shape with rammed or gunned refractory interspersed between.

The metallurgical vessel for performing the HIsmelt process presents unique problems in that the process operates continuously, and the vessel must be closed up as a pressure vessel for long periods, typically of the order of a year or more and then must be quickly relined in a short period of time as described in U.S. Pat. No. 6,565,798 in the name of the applicant.

The refurbishment of the vessel requires access for entry of not only personnel but also entry of reasonably heavy duty equipment such as a bob cat or similar vehicle fitted with hydraulically powered tools. When in service the vessel must be capable of with standing very high internal pressures. Accordingly the vessel must be designed as a pressure vessel capable of withstanding such internal pressures and any removable door or panel intended to provide access for refurbishment must be designed so as to be capable of sealing against that pressure in service. The pressures generated in the base of the vessel during service are significant due to refractory compression and the head of molten iron and slag so that any access door panel located in the base of the vessel must be extremely robust and be provided with massive sealing flanges and clamping bolts. The present invention enables appropriate access to be achieved through an access panel which can be of lighter construction and which can be sized for ease of removal from the vessel with minimal disruption to surrounding equipment.

DISCLOSURE OF THE INVENTION

According to the invention there is provided a metallurgical vessel having a cylindrical upper end section and a top section fitted to the upper end of that cylindrical section to form a top closure of the vessel about a central opening through which to extend a gas injection lance for injection of hot gas into the vessel, wherein the top section is formed from an outer inwardly concavely curved annular panel fastened to the upper end of the cylindrical section and an inner inwardly concavely curved annular panel removably fastened to the outer panel, the inner periphery of the inner annular panel defining said internal opening of the top section, and the inner annular panel being removable to provide access to the interior of the vessel.

The internal faces of the inner and outer panels may conform to a curved surface extending from the upper end of the cylindrical section to the inner periphery of the inner panel. More specifically, the inner faces of the two panels may conform to a continuously curved dome.

The inner and outer annular panels of the top section may be provided with upstanding concentric annular flanges and may be removably fastened to one another by clamping means effective to clamp those flanges together.

Upper parts of the upstanding annular flanges may be provided with outurned edge flanges and the clamping means may clamp the outurned edge flanges together.

More particularly, the upstanding annular flange of the inner annular panel may extend upwardly above the upper extremity of the upstanding annular flange of the outer annular panel and its outurned edge flange may overlay the outurned edge flange of the outer panel.

The clamping means may comprise clamping bolts extended through circumferentially spaced openings in the out turned flanges.

The outer annular panel of the top section may be permanently fastened to the upper end of the cylindrical section by a continuous weld.

The inner periphery of the inner annular panel of the top section may be provided with an upstanding cylindrical part to receive the gas injection lance.

The upper end of the upstanding cylindrical part may be provided with a radially outwardly projecting annular flange for attachment to the lance.

The outer annular panel of the top section may be provided internally with water cooling panels.

The inner annular panel of the top section may also be provided internally with water cooling panels.

The inner diameter of the inner ring may be in the range 1 to 1.5 meters.

The outer diameter of the inner ring may be in the range 2.5 meters to 3 meters.

According to a further aspect of the present invention there is provided a direct smelting plant comprising a direct smelting vessel having a plurality of cooling panels located internally of said vessel and a plurality of panel inlet couplings and panel outlet couplings located on an external surface of said vessel and said couplings connected to supply piping and said supply piping extending between said couplings and supply headers, an access tower providing access to said vessel and supporting said supply headers and supply piping, a removable access panel located in a roof of said vessel, wherein said supply headers, supply piping and access tower are positioned around said vessel so as to provide an access corridor above said access panel for installation and removal of said access panel.

The corridor may extend generally vertically upwards from the removable access panel. It may have an outer boundary extending upwardly from the region of the outer periphery of the access panel.

Preferably said supply headers are positioned on said access tower at a level above said access panel and said supply piping extends from said headers to couplings located on said vessel at levels below said access panel.

Preferably said access panel is sized for insertion and removal of said cooling panels internally of said vessel.

Preferably said access corridor is substantially free of supply piping, supply headers and structural members of said access tower whereby in use, removal of said access panel requires no or limited disassembly of said supply piping, supply headers or structural members of said access tower.

Preferably said access panel locates cooling panels on an internal surface and couplings on an external surface and wherein supply piping for said cooling panels located on said access panel extends into said access corridor.

Preferably said headers are located adjacent an external perimeter of said access tower and wherein said piping extends to connections on said vessel via one or more routes extending vertically downward and laterally across said access tower and which said one or more route are substantially independent of said access corridor.

Preferably an injection lance extends through an aperture in said access panel and wherein at least part of said injection lance is located in said access corridor.

Preferably said aperture of said access panel and said injection lance are located coaxially with said access corridor.

Preferably said access tower comprises an access platform located above said roof of said vessel for providing access to said injection lance and having an aperture defining a portion of said access corridor.

Preferably said injection lance extends through said aperture in said access platform.

Preferably said injection lance is water cooled and comprises couplings for connection to supply pipes and wherein a portion of said supply pipes for said lance extend into said access corridor.

BRIEF DESCRIPTION OF THE DRAWINGS

In order that the invention may be more fully explained, one particular embodiment will be described in some detail with reference to the accompanying drawings in which.

DETAILED DESCRIPTION OF THE PREFERRED EMBODIMENT

Figure 1:
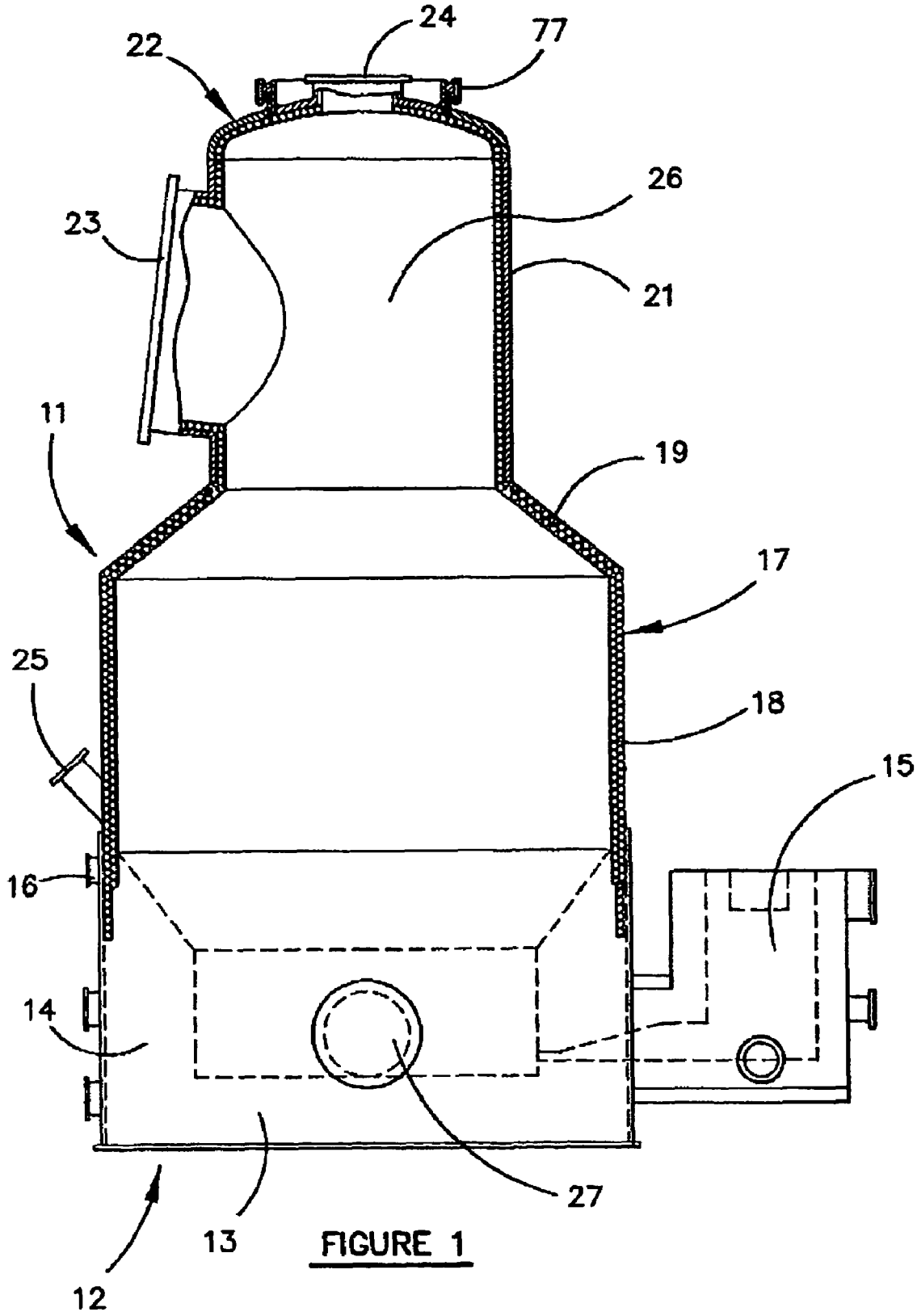
FIG. 1 is a vertical cross-section through a direct smelting vessel provided with internal cooling panels.
Figure 2:
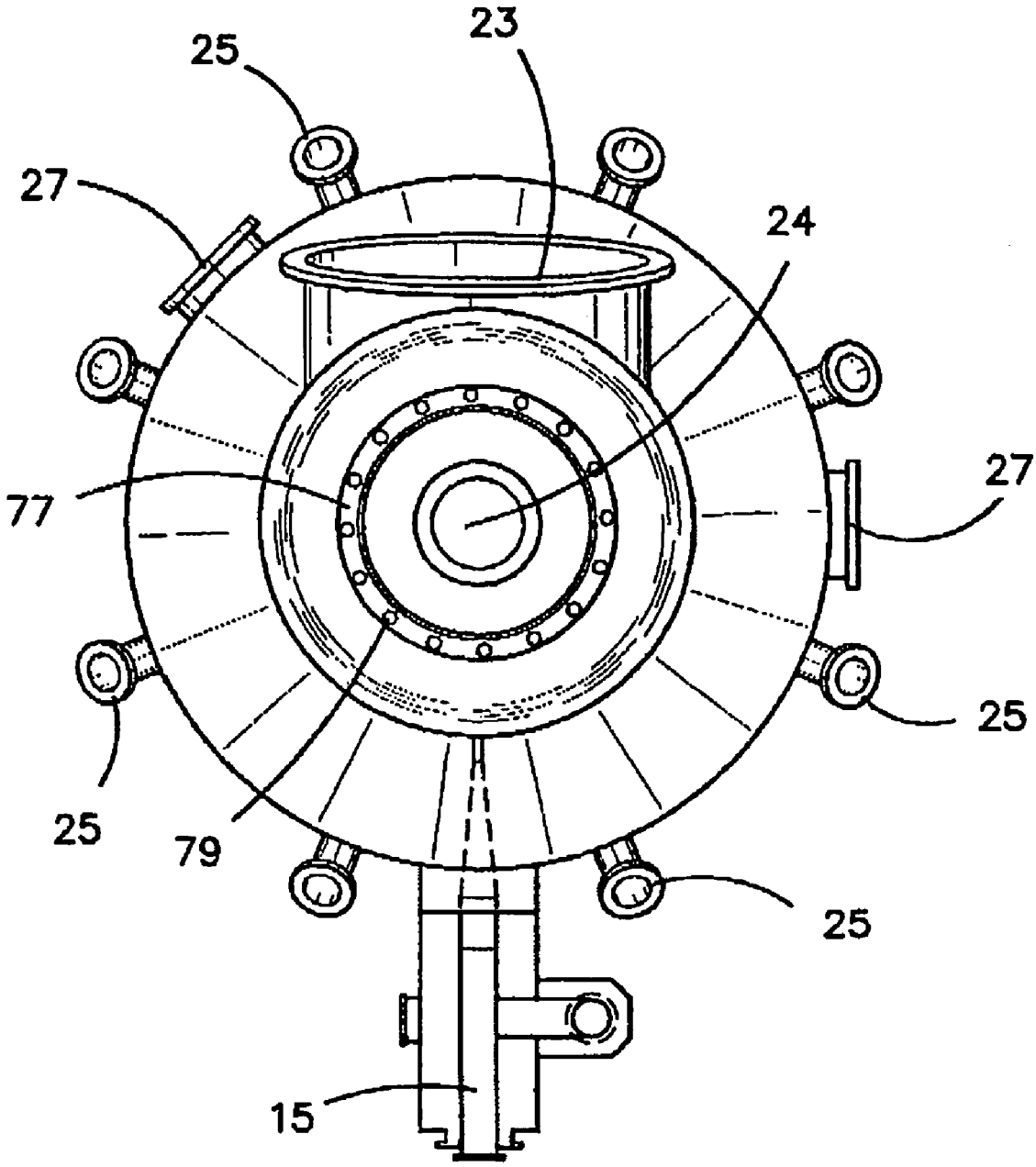
FIG. 2 is a plan view of the vessel shown in FIG. 1.
Figure 3:
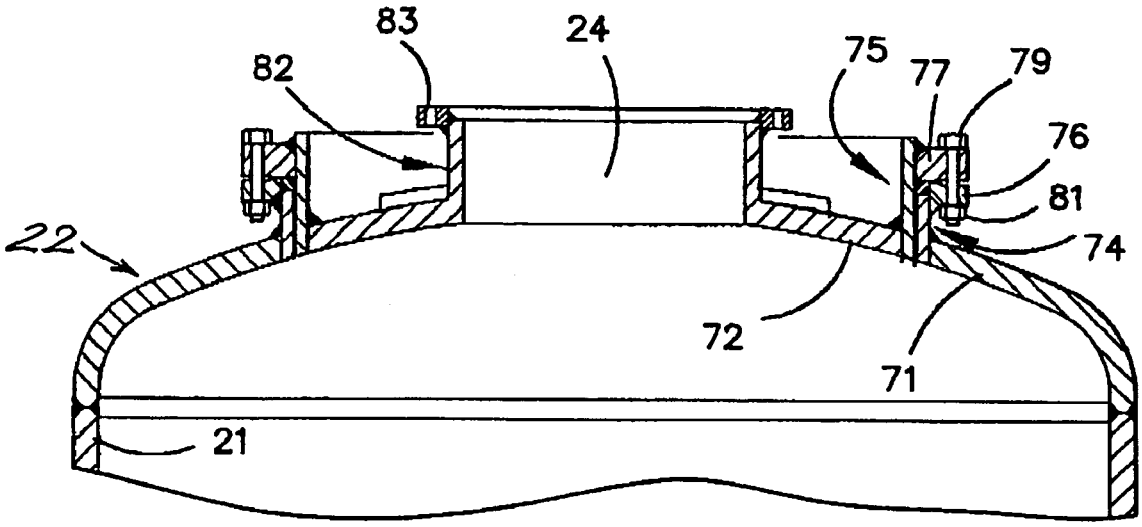
FIG. 3 illustrates a top section of the vessel.
Figure 4:
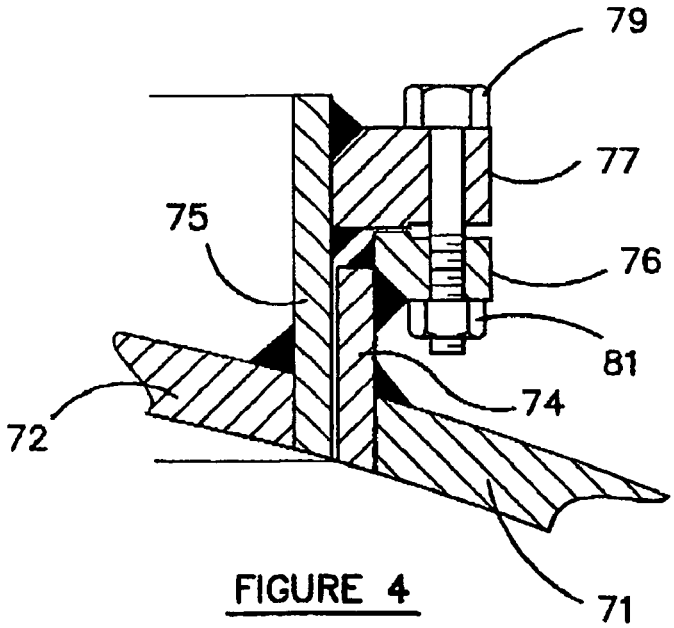
FIG. 4 shows a detail of the top section of the vessel.

FIGS. 1 to 4 illustrate a direct smelting vessel suitable for operation of the HIsmelt process as described in U.S. Pat. No. 6,267,799 and International Patent Publication WO 96/31627. The metallurgical vessel is denoted generally as 11 and has a hearth 12 which includes a base 13 and sides 14 formed of refractory bricks, a forehearth 15 for discharging molten metal continuously and a tap hole 16 for discharging molten slag.

The base of the vessel is fixed to the bottom end of an outer vessel shell 17 made of steel and comprising a cylindrical main barrel section 18, an upwardly and inwardly tapering roof section 19, and an upper cylindrical section 21 and top section 22 defining an offgas chamber 26. Upper cylindrical section 21 is provided with a large diameter outlet 23 for offgases and the top section 22 has an opening 24 in which to mount a downwardly extending gas injection lance for delivering a hot air blast into the upper region of the vessel. The hot gas injection lance 106 is internally water cooled, being provided with inner and outer annular coolant flow passages for inward and outward flow of cooling water. More particularly, this lance may be of the general construction disclosed in U.S. Pat. No. 6,440,356.

The main cylindrical section 18 of the shell has eight circumferentially spaced tubular mountings 25 through which to extend solids injection lances for injecting iron ore, carbonaceous material, and fluxes into the bottom part of the vessel. The solids injection lances are also internally water cooled, being provided with inner and outer annular coolant flow passages for inward and return flows of cooling water. More particularly, the solids injection lances may be of the general construction disclosed in U.S. Pat. No. 6,398,842.

In use the vessel contains a molten bath of iron and slag and the upper part of the vessel must contain hot gases under high pressure and extremely high temperatures of the order of 1200° C. The vessel is therefore required to operate as a pressure vessel over long periods and it must be of robust construction and completely sealed.

In a typical installation the main barrel section 18 may be of the order 10 meters in diameter and the upper cylindrical section 21 may be of the order of 5.5 meters in diameter. Typically the upper parts of the vessel may be required to with stand internal pressures of the order of 1.5 to 2 bar and any removable access panel in that part of the vessel must be capable of being firmly secured in position to withstand such internal pressure.

The top section 22 of the vessel is formed as a two part domed construction. More particularly, it is formed from an outer annular panel 71 fastened to the upper end of the cylindrical section 21 of the barrel and an inner annular panel 72 removably fastened to the outer panel 71, both panels being formed with inwardly concave curvature so that when fitted together their inner faces conform to a curved surface. More specifically, the panels together form the continuously domed shaped top section 22.

The outer annular panel 71 is welded to the upper end of the upper cylindrical section 21 of the vessel by a continuous circumferential weld 73 so that it becomes an integral part of the pressure vessel. The inner periphery of outer panel 71 and the outer periphery of the inner panel 72 have upstanding annular flanges 74, 75 arranged concentrically about the centre line of the top section. The upper parts of flanges 74, 75 have out-turned edge flanges 76, 77 connected to them by strong welds. Upstanding flange 75 of the inner panel 72 extends upwardly above the flange 74 of panel 71 and its out-turned flange 77 overlays the out-turned flange 76 of the outer panel. The two panels are fastened together by clamping bolts 79 passed through circumferentially spaced holes in the abutting flanges 76, 77 and fitted with clamping nuts 81.

The inner periphery of inner panel 72 forms the opening 24 to receive the hot gas injection lance. This inner periphery of panel 72 is provided with an upstanding cylindrical tubular projection 82 the upper end of which carries a radially outwardly projecting flange 83. The flanged cylindrical projection 82 provides a firm mounting for the gas injection lance 20, the lance being provided with an outwardly projecting flange to sit on the flange 82 so that the flanges 82, 84 can be firmly clamped together by appropriate clamping bolts and nuts.

The illustrated construction of the top section 22 of the vessel allows the vessel to with stand high internal pressures of the order of at least 1.5 to 2 bar absolute during operation while providing for ready access to the interior of the vessel when necessary. The arrangement allows for removal of the hot air injection lance 20 by removal of the clamping bolts and nuts clamping the flange 82 to the lance flange whereupon the hot air injection lance can be withdrawn vertically upwards through the central opening 24 in the top section 22. In some circumstances this is all that will be required for servicing and replacement of the lance. However if access to the interior of the vessel is required for maintenance or refurbishment the clamping bolts and nuts 79, 81 clamping the outer and inner panels 71, 72 together can be removed and the inner panel 72 taken out to provide a circular access opening defined by the inner periphery of outer panel 71. This may typically be of the order of 2.0 meters in diameter to allow heavy duty equipment such as a bobcat to be lowered downwardly into the vessel, whilst being small enough to be removed and taken away with minimal disturbance to surrounding equipment.

Vessel shell 11 is internally lined with a set of 99 individual cooling panels through which cooling water can be circulated and these cooling panels are covered with spray coated refractory material to provide a water cooled internal refractory lining for the vessel above the smelting zone. It is important that the refractory lining be virtually continuous and that all of the refractory material be subject to cooling as uncooled refractory will be rapidly eroded. The panels are formed and attached to the shell in such a way that they can be installed internally within the shell 11 and can be removed and replaced individually on shut down without interfering with the integrity of the shell or to require re-testing as a pressure vessel.

The cooling panels consist of a set of forty-eight panels 31 lining the main cylindrical barrel section 18 of the shell, a set of sixteen panels 32 lining the tapering roof section 19, and four panels 33, twenty panels 34 and eleven panels 35 lining the upper parts of the shell forming the off gas chamber 26. Panels 35 line the internal surface of top section 22 of the vessel. More specifically six of these panels line the internal surface of outer annular panel 71 and the remaining three panels are fitted to the inner annular panel 72 of top section 22. Accordingly only three of the cooling panels need to be disconnected from the water supply lines and control valves when the inner panel 72 of top section 22 is to be removed for access to the interior of the vessel. All the other water panels can remain in the vessel and their water supply lines and control valves do not need to be disconnected or moved.

Figure 5:
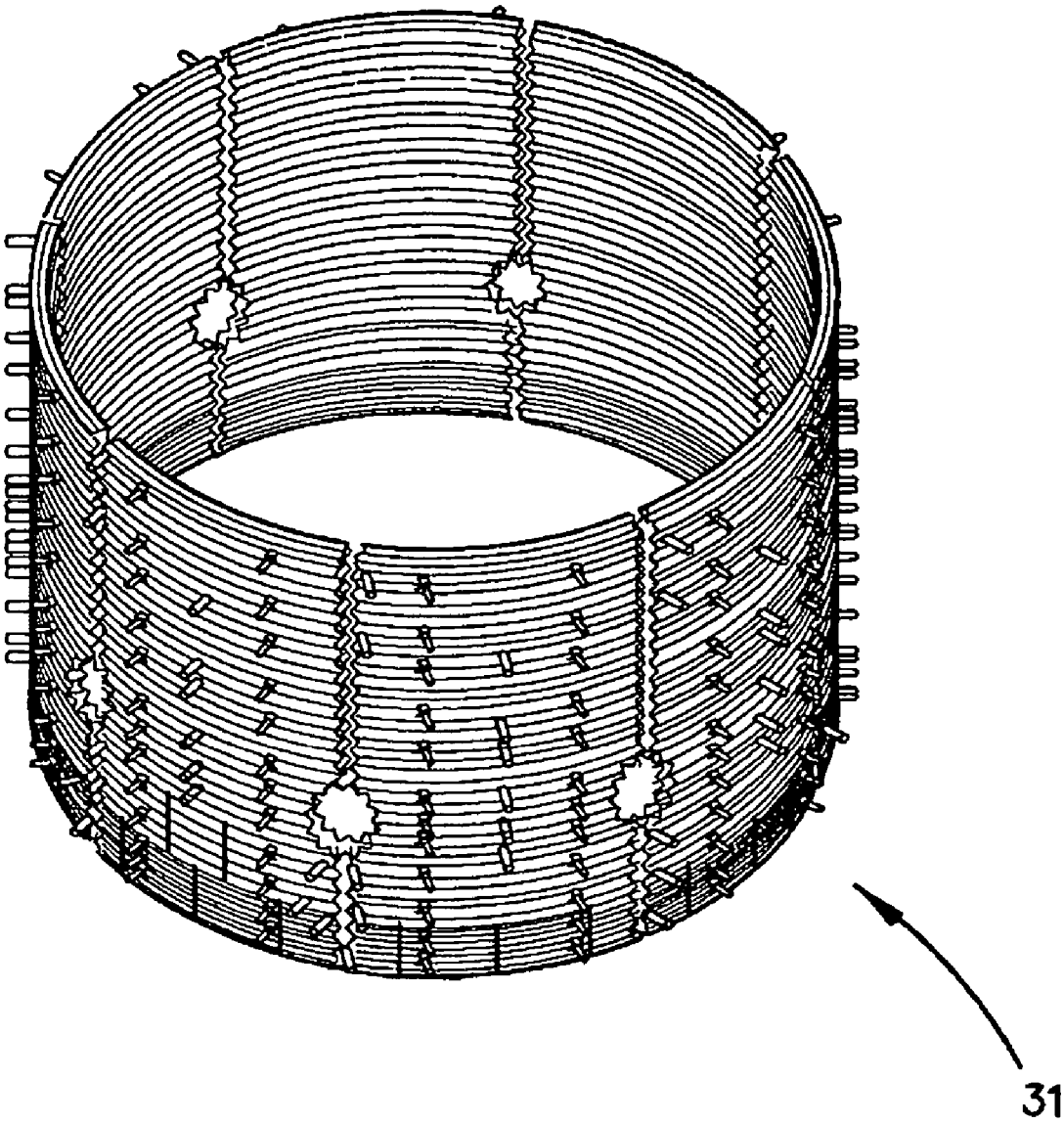
FIG. 5 illustrates the arrangement of cooling panels lining a main cylindrical barrel part of the vessel.
Figure 6:
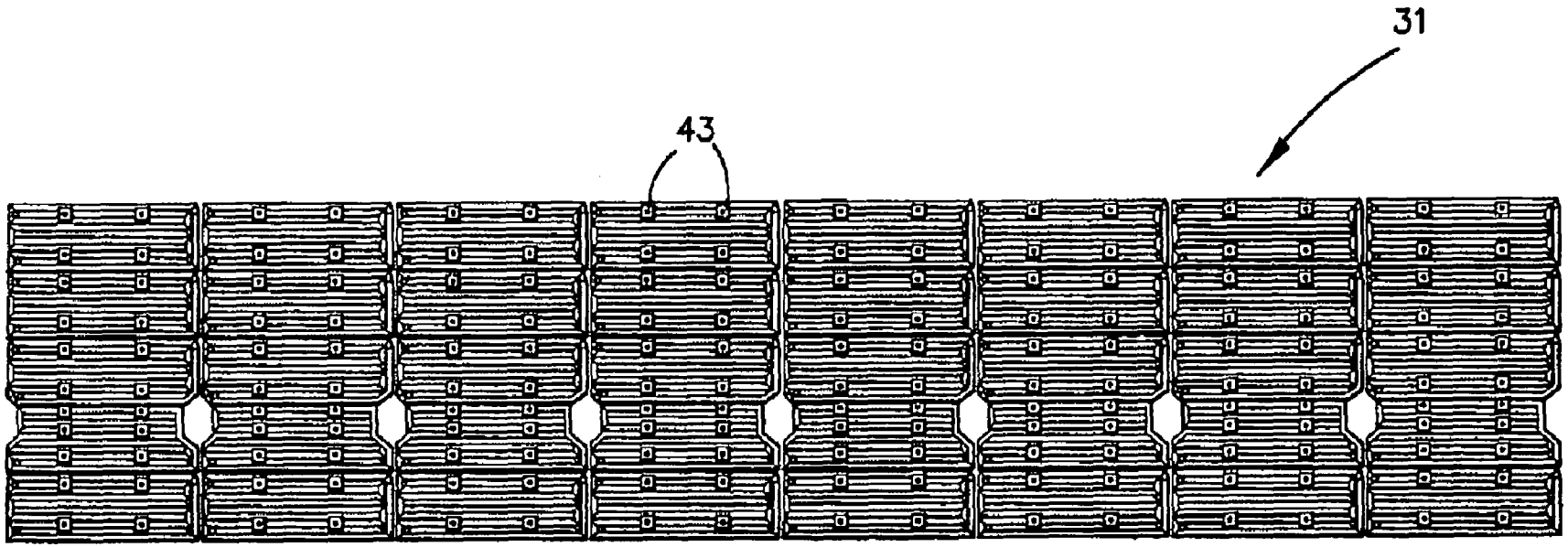
FIG. 6 is a development of the cooling panels shown in FIG. 3.
Figure 7:
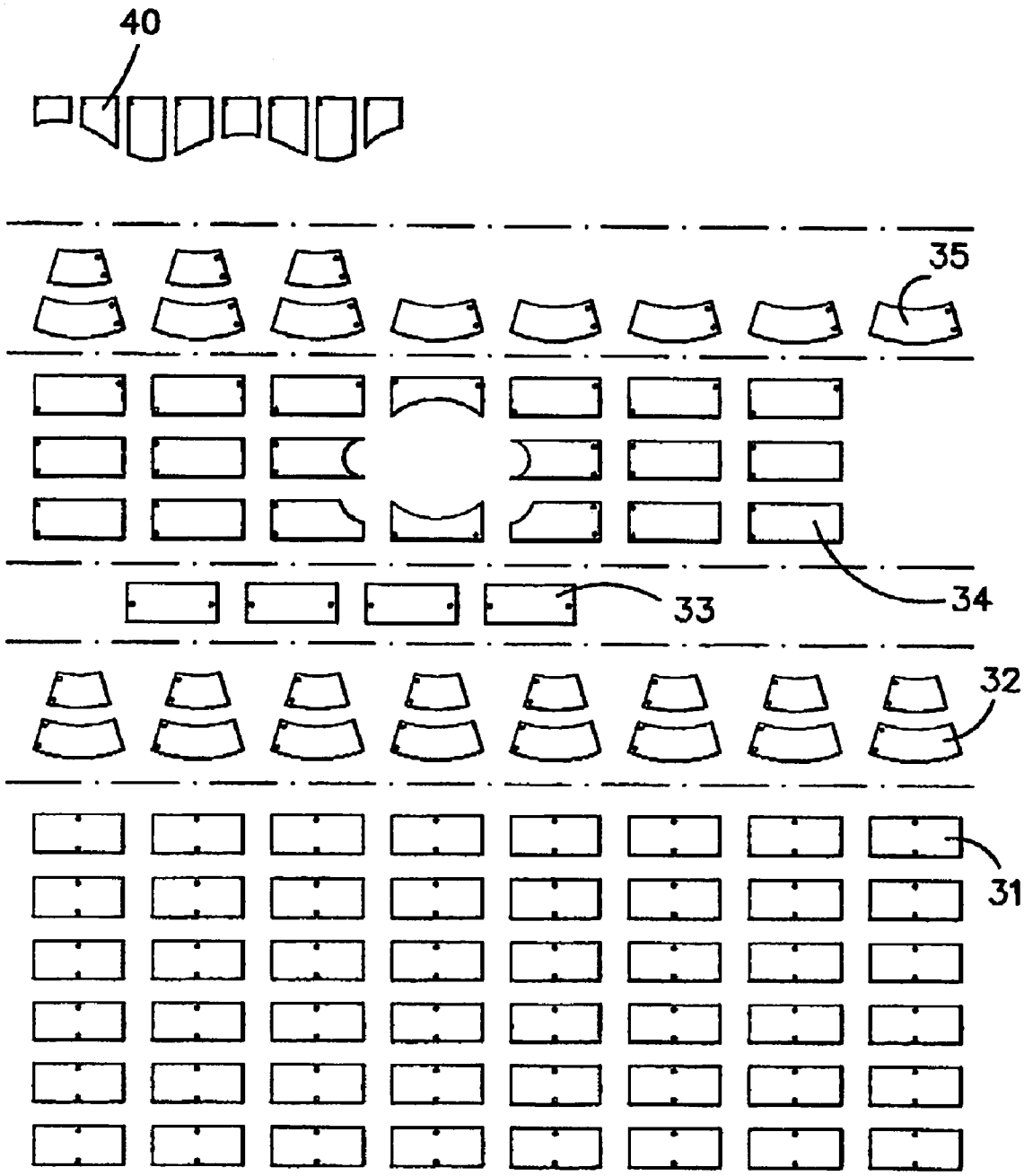
FIG. 7 is a development showing diagrammatically the complete set of cooling panels fitted to the vessel.
Figure 8:
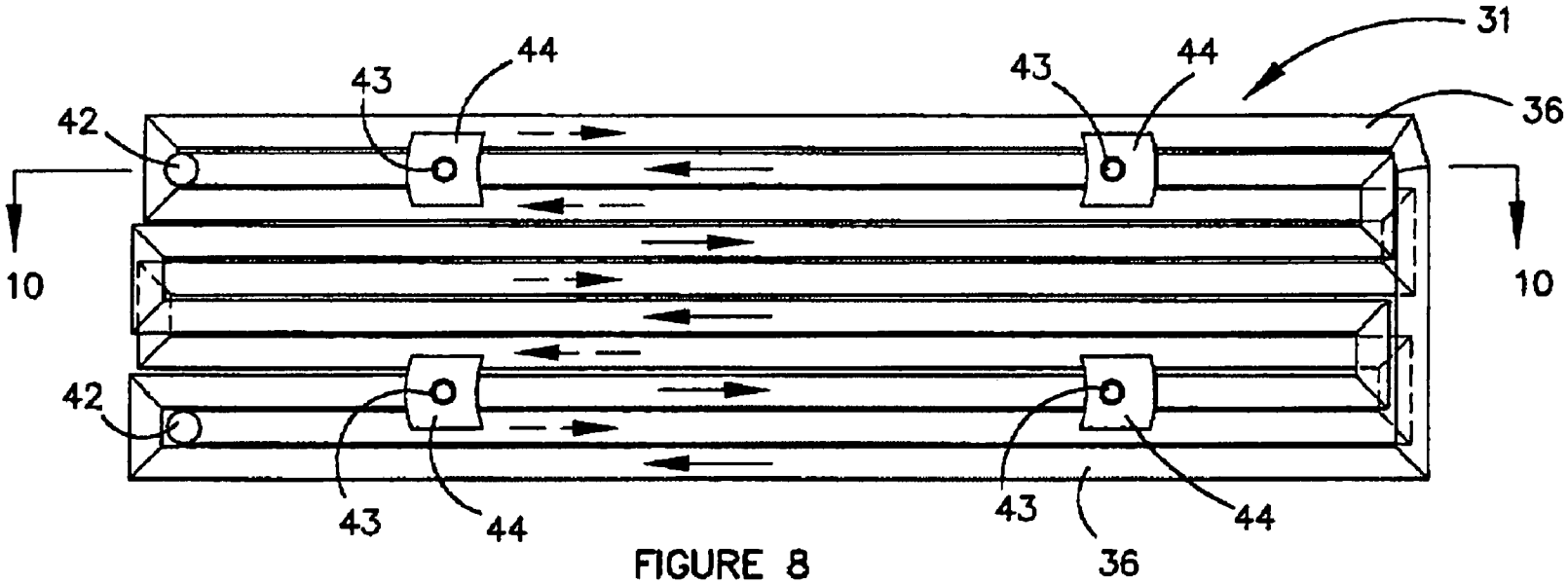
FIG. 8 is an elevation of one of the cooling panels fitted to the cylindrical barrel section of the vessel.
Figure 9:
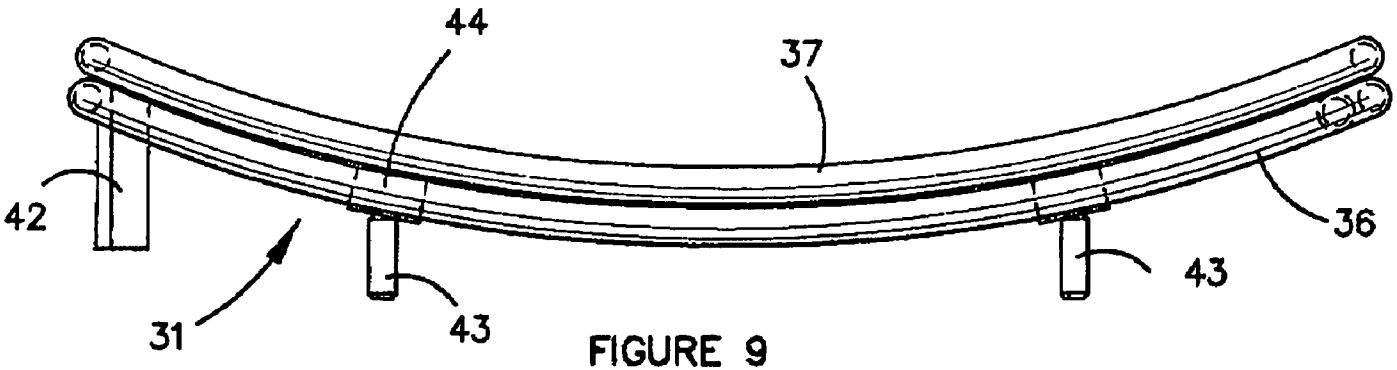
FIG. 9 is a plan of the panel shown in FIG. 7.
Figure 10:
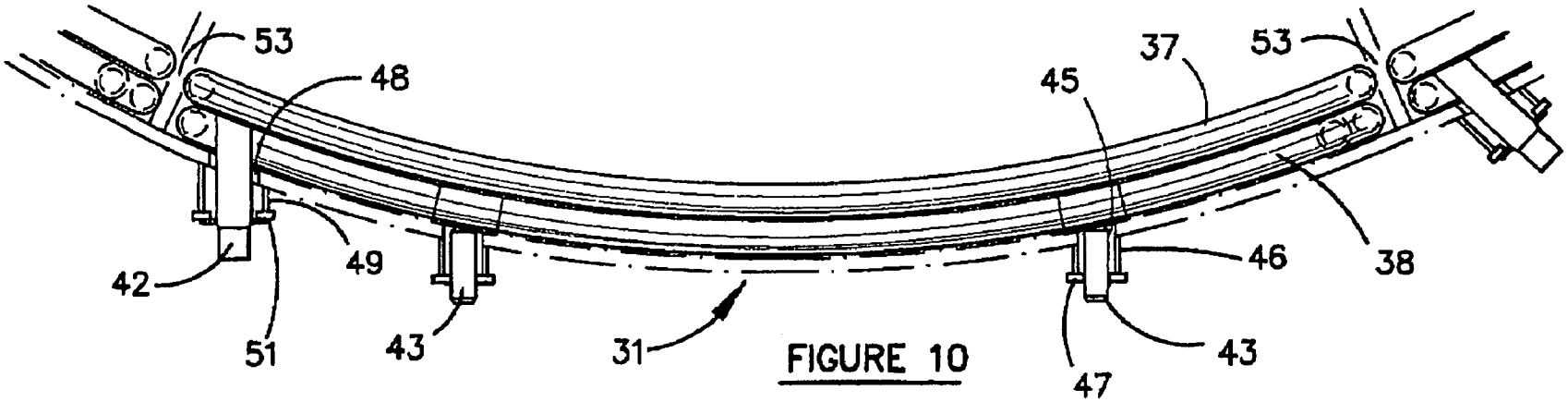
FIG. 10 is a cross-section on the line 10-10 in FIG. 8.
Figure 11:
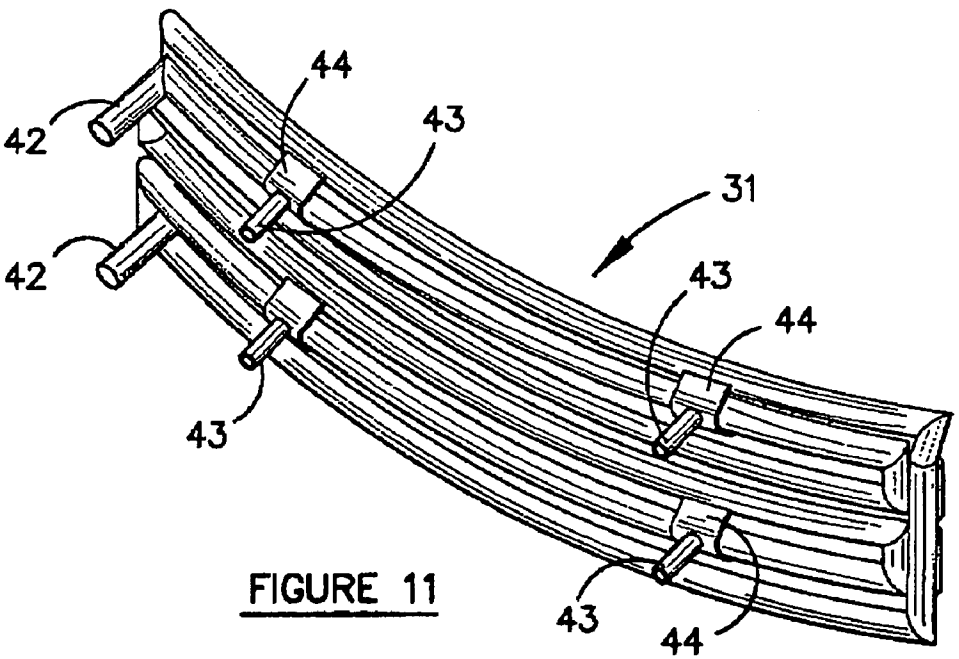
FIG. 11 is a front view of the cooling panel illustrated in FIG. 8.
Figure 12:
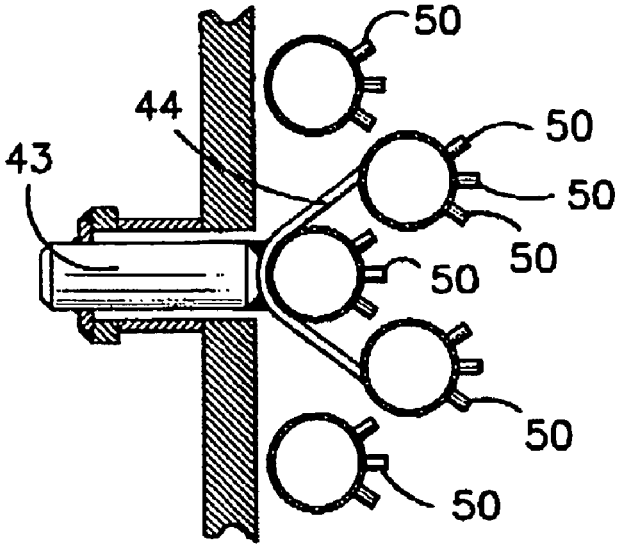
FIG. 12 illustrates a detail of the cooling panel.
Figure 13:
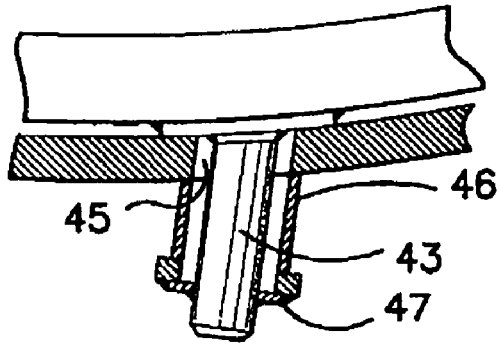
FIGS. 13 and 14 illustrate details of the connection of a cooling panel to the vessel shell.
Figure 14:
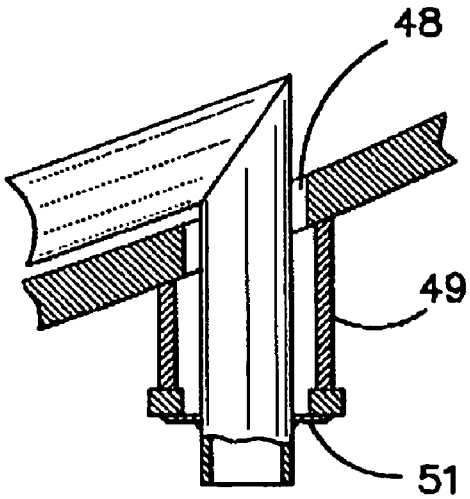

The construction of panels 31 and the manner in which they are mounted on the main cylindrical barrel 18 of the vessel shell is illustrated in FIGS. 8-14. As shown in FIGS. 5, 6 and 7, these panels are disposed in 6 vertically spaced tiers of arcuate panels spaced circumferentially of the vessel, there being eight individual panels 31 in each tier. Each panel 31 is comprised of a coolant flow tube 36 bent to form inner and outer panel sections 37, 38 of zigzag formation. Coolant inlet and outlet tubular connectors 42 extend from the inner panel section at one end of each panel. Panels 31 are of elongate arcuate formation with a curvature to match the curvature of the main cylindrical barrel section 18 of the shell.

A set of four mounting pins 43 are connected to the zigzag tubular formation of the outer panel section 38 by means of connector straps 44 so as to project laterally outwardly from the panel. Each connector strap 44 is fastened at its ends to adjacent tube segments of the inner panel section and extends between its ends outwardly across a tube segment of the outer panel section in the manner shown most clearly in FIG. 10. The connector straps 44 are generally V-shaped with the root of the V-shape curved to fit snugly about the tube segment of the outer panel section. The pins 43 are welded to the connector straps so as to extend outwardly from the roots of the V-shapes. The connecting straps serve to brace the panels by holding the tube segments securely in spaced apart relationship at multiple locations distributed throughout the panels, resulting in a strong but flexible panel construction.

The mounting pins 43 are extended through openings 45 in the shell and tubular protrusions 46 surrounding the openings 45 and protruding outwardly from the shell. The ends of pins 46 project beyond the outer ends of the tubular protrusions 46 and are connected to the outer ends of those protrusions by welding annular metal discs 47 to the pins and protrusions thus forming connections exteriorly of the shell in a way which seals the openings 45.

In similar fashion the inlet and outlet connectors, 42 for the panel project outwardly through openings 48 in the shell and through and beyond tubular protrusions 49 surrounding those openings and protruding outwardly from the shell and connections are made by welding annular discs 51, between the connectors 42 and the protrusions 49. In this way, each panel 31 is mounted on the shell through the four pins 43 and the coolant connectors 42 at individual connections exteriorly of the shell. The pins and coolant connectors are a clearance fit within the tubular protrusions tubes 46, 49 and the panel is free to move to accommodate thermal expansion and contraction movements or movements caused by contact with material within the vessel.

The pins 43 and the coolant inlet and outlet connectors 42 are oriented so as to project laterally outwardly from the panel in parallel relationship to one another and so as to be parallel with a central plane extended laterally through the panel radially of the vessel so that the panel can be inserted and removed by bodily movement of the panel inwardly or outwardly of the cylindrical barrel of the vessel.

The gaps 53 between the circumferentially spaced panel 31 must be sufficient to enable the trailing outer edges of a panel being removed to clear the inner edges of the adjacent panels when the panel to be removed is withdrawn inwardly along the direction of the pins 46 and connectors 42. The size of the gaps required is dependent on the length of the arcuate panels and therefore the number of panels extending the circumference of the barrel section 18. In the illustrated embodiment there are eight circumferentially spaced panels in each of the six tiers of panels 31. It has been found that this allows minimal gaps between the panels and ensures proper cooling of refractory material at the gaps. Generally for satisfactory cooling it is necessary to divide each tier into at least six circumferentially spaced panels.

Refractory retainer pins 50 are butt welded to the coolant tubes of panels 31 so as to project inwardly from the panels and act as anchors for the refractory material sprayed out the panels. Pins 50 may be arranged in groups of these pins radiating outwardly from the respective tube and arranged at regular spacing along the tube throughout the panel.

The panels 33 and 34, being fitted to cylindrically curved sections of the vessel, are formed and mounted in the same fashion as the panels 31 as described above, but some of the panels 34 are shaped in the manner shown in FIG. 7 so as to fit around the off gas outlet 23.

The panels 32 and 35, being fitted to tapered sections of the shell, are generally conically curved in the manner shown in the illustrated development of FIG. 7. Except for this variance in shape. However, these panels are also formed and mounted to the shell in similar fashion to the panels 31, each being fitted with mounting pins projecting laterally outwardly from the panel and a pair of inlet/outlet coolant connectors at opposite ends of the panels, the pins and connectors being extended through openings in the shell and connected to tubes projecting laterally outwardly from the shell to form connections exteriorly of the shell which seal the openings and provide a secure mounting for the panels while permitting some freedom of movement of the panels.

Referring now to FIGS. 15 through 18 there is illustrated an access tower 101 that provides support for water cooling circuits that supply coolant water to the water cooled equipment located on the vessel 11. The access tower also provides personnel with access to the vessel and to the water cooled equipment and circuits.

Figure 15:
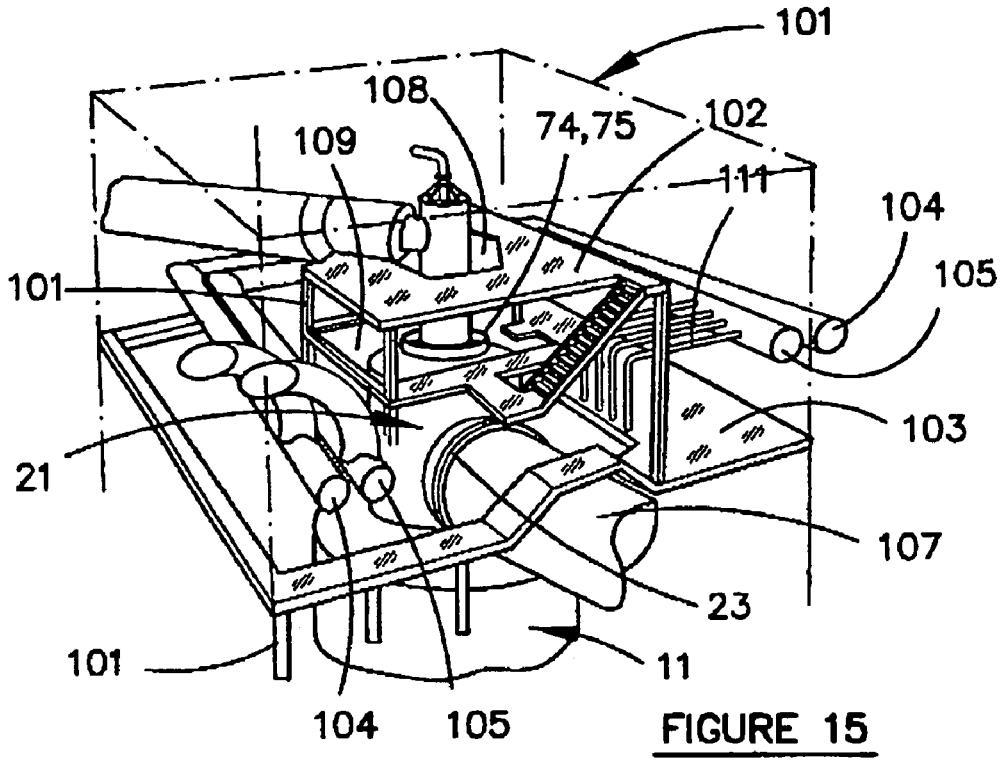
FIG. 15 illustrates an upper portion of a tower that surrounds the vessel.
Figure 16:
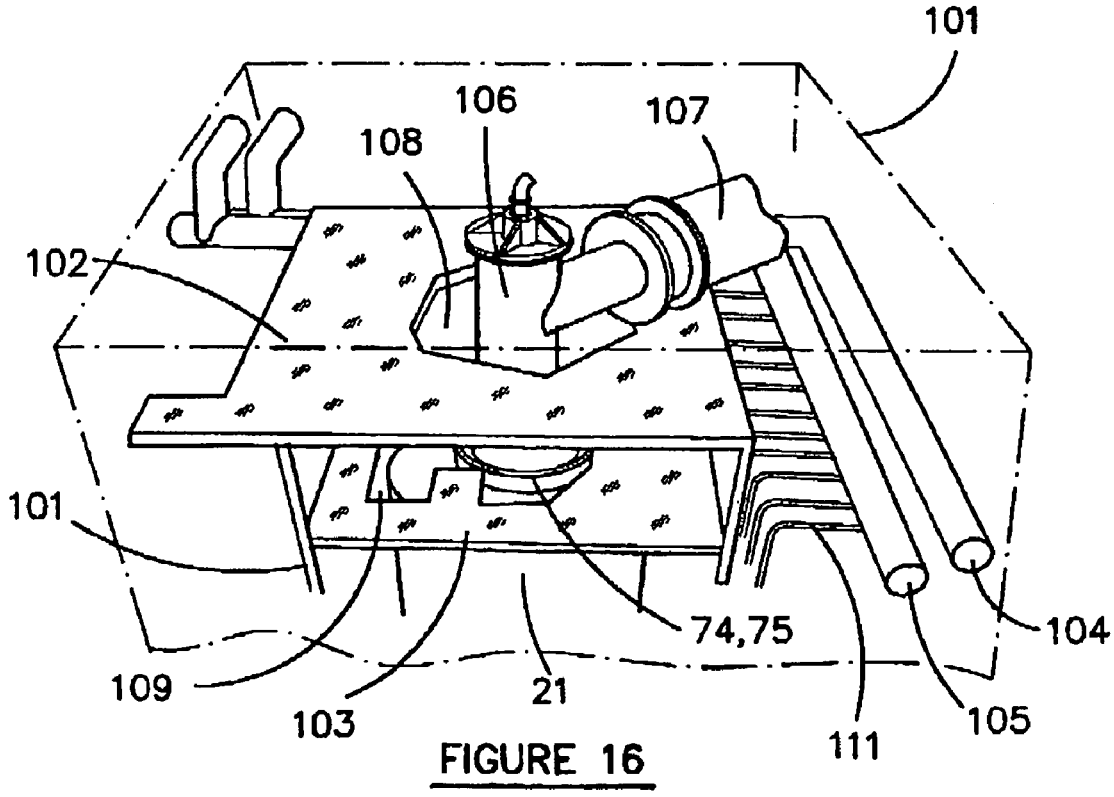
FIG. 16 illustrates the tower of FIG. 15 in greater detail in the region of a top floor of the tower and a hot air injection lance.

In FIGS. 15 and 16 a top floor 102 and a second floor 103 of the access tower 101 are visible along with supply headers 104, 105 for flow of coolant water to and from water cooled equipment located on the vessel.

A top portion of a gas injection lance 106 (which may be a hot air blast (HAB) injection lance) is shown as projecting above the top floor of the access tower. A supply duct 107 for supplying oxygen containing gas, such as hot air blast, extends above the top surface of the access tower and connects to the gas injection lance 106.

Figure 17:
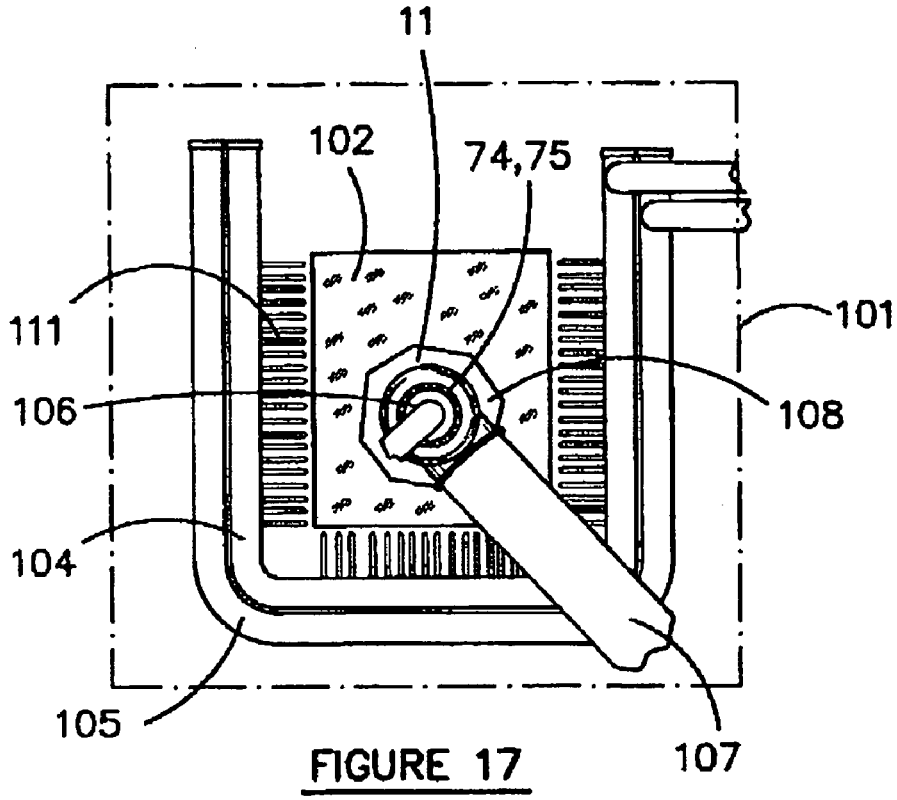
FIG. 17 is a top view of the tower of FIG. 15 in greater detail and showing an access panel, the top and a second floor of the tower and cooling water supply mains.
Figure 18:
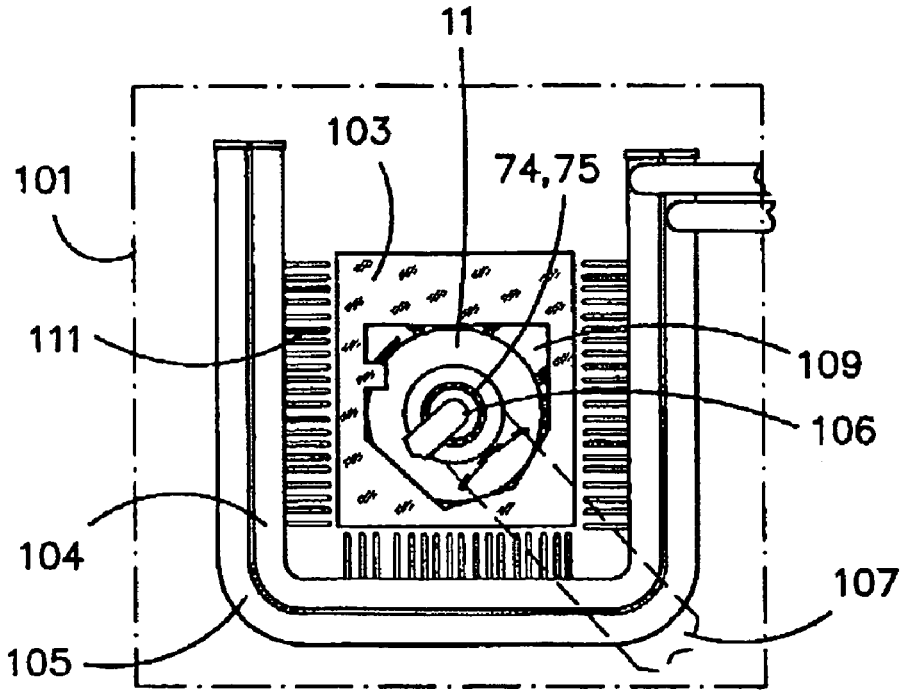
FIG. 18 provides a top sectional view through the tower of FIG. 15 between the top and second floors and shows the access panel along with water cooling supply and return pipes that service water cooled panels retained on an internal surface of the access panel.

In FIGS. 15, 17 & 18, upstanding flanges 74 & 75 are visible as is inner panel 72. The gas injection lance extends through opening 24 of inner panel 72 into the interior of the vessel. The gas injection lance is located co-axially with inner panel 72 and aperture 24.

The top floor 102 and the second floor 103 of the access tower contain access apertures 108, 109 which are sized to receive the inner panel 72 for both installation and removal. The gas injection lance 106 is also sized so as to pass through the access apertures 108, 109 of the top and second floors 102, 103. The access apertures 108, 109 in the top and second floors of the access tower are co-axially aligned so as to provide an access corridor having an external envelope that extends upwardly from, adjacent an external edge of inner panel 72 to above the top floor of the access tower. The external envelope of the access corridor is sized so that the inner panel 72 and the gas injection lance can pass along the corridor when being installed or removed from the vessel. When installed, at least part of the gas injection lance is retained within the corridor.

Supply headers 104, 105 for supply of coolant water to water cooled equipment on the vessel, such as the gas injection lance 106 and water cooled panels 31, 32, 33, 34, 35 are located at a height above the inner panel 72. The headers 104, 105 extend around an external periphery of the access tower. Supply piping 111 extends from the supply headers to connections on the water cooled equipment. Much of the supply piping extends to various levels on the vessel below the inner panel 72 and typically extend laterally across the tower from the external periphery to connections on the vessel. In this regard, the supply piping and supply headers are configured so that they do not pass through the access corridor. Similarly a minimum, if any, of the structural members of the access tower 101 pass through the access corridor. This is to minimize the extent of the plant that needs to be disassembled in order for the inner panel 72 and the gas injection lance to be installed and removed.

However, the inner panel 72 does retain some water cooled panels and as such has connection points on its external surface to which supply piping of the water cooling system is connected. Accordingly, some of the supply piping of the water cooling system penetrates the external envelope of the access corridor and is retained internally of the access corridor. Accordingly, such supply piping needs to be either disassembled before the inner panel 72 can be removed from the vessel or installed after installation of the inner panel 72. Similarly, the gas injection lance is water cooled and supply piping for the gas injection lance is retained within the access corridor and must be disassembled before the gas injection lance can be removed or installed after installation of the gas injection lance. Typically, it is only supply piping for water cooled elements that are located within the access corridor that penetrate the external envelope of the access corridor.

Providing a dedicated access corridor that requires minimal disassembly of supply piping of the water cooling circuit and structural members of the access tower itself minimizes the extent of construction activity associated with replacement of the gas injection lance.

The interior of the vessel is also primarily accessed through inner panel 72 as the other access points in the vessel either require the refractory lined hearth located in the base of the vessel to be disassembled or do not provide direct access into the vessel at all. Minimizing the extent of construction activity associated with installation and removal of the inner panel 72 assists with reducing the amount of time required to perform such operations. Typically inner panel 72 would be removed to perform maintenance or replacement of water cooled panels located internally of the vessel shell. Accordingly the inner panel 72 is sized so as to received water cooled panels for installation onto the vessel wall. Typically the inner panel has a diameter of approximately two meters.

The illustrated vessel has been advanced by way of example only. The physical construction of the vessel and the cooling panels could be varied and it is to be understood that such variations can be made without departing from the scope of the appended claims.

The invention claimed is:

1. A metallurgical vessel comprising: a cylindrical upper end section and a top section fitted to the upper end of that cylindrical section to form a top closure of the vessel about a central opening through which to extend a gas injection lance for injection of hot gas into the vessel, wherein the top section is formed from an outer inwardly concavely curved annular panel permanently fastened to the upper end of the cylindrical section by a continuous weld and an inner inwardly concavely curved annular panel removably fastened to the outer panel, the inner periphery of the inner annular panel defining said central opening of the top section, the inner annular panel being removable to form a wider diameter opening to provide access to the interior of the vessel, a continuously curved dome extending from the upper end of the cylindrical section to the inner periphery of the inner panel, with the dome conforming to the internal faces of the inner and outer panels, and the inner periphery of the inner annular panel being provided with an upstanding cylindrical part adapted to receive the gas injection lance whereby in use the lance is supported by the vessel, said vessel being configured to carry out a continuous iron making process at a pressure in the range of 1.5 to 2 bar absolute in the vessel.

2. A metallurgical vessel as claimed in claim 1, wherein the inner and outer annular panels of the top section are provided with upstanding concentric annular flanges and are removably fastened to one another by clamping means effective to clamp those flanges together.

3. A metallurgical vessel as claimed in claim 2, wherein upper parts of the upstanding annular flanges are provided with outurned edge flanges and the clamping means clamp the outurned edge flanges together.

4. A metallurgical vessel as claimed in claim 3, wherein the upstanding annular flange of the inner annular panel extends upwardly above the upper extremity of the upstanding annular flange of the outer annular panel and its outurned edge flange overlays the outurned edge flange of the outer panel.

5. A metallurgical vessel as claimed in claim 4, wherein the clamping means comprises clamping bolts extended through circumferentially spaced openings in the out turned flanges.

6. A metallurgical vessel as claimed in claim 2, wherein the upper end of the upstanding cylindrical part is provided with a radially outwardly projecting annular flange for attachment to the lance.

7. A metallurgical vessel as claimed in claim 2, wherein the outer annular panel of the top section is provided internally with water cooling panels.

8. A metallurgical vessel as claimed in claim 7, wherein the inner annular panel of the top section is provided internally with water cooling panels.

9. A direct smelting plant comprising;

(a) a metallurgical vessel having a cylindrical upper end section and a top section fitted to the upper end of that cylindrical section to form a top closure of the vessel about a central opening disposed to receive a gas injection lance for injection of hot gas into the vessel with the lance being supported by the vessel, wherein the top section is formed from an outer inwardly concavely curved annular panel fastened to the upper end of the cylindrical section and an inner inwardly concavely curved annular panel removably fastened to the outer panel, the inner periphery of the inner annular panel defining said central opening of the top section, the inner annular panel being removable to form a wider diameter opening to provide access to the interior of the vessel, the internal faces of the inner and outer annular panels conforming to a continuously curved dome extending from the upper end of the cylindrical section to the inner periphery of the inner panel, and wherein the outer diameter of the inner annular panel is in a range of 2.5 to 3.0 meters;

(b) a plurality of cooling panels located internally within said vessel, (c) a plurality of panel inlet couplings and panel outlet couplings located on an external surface of said vessel, (d) water flow piping connected between said couplings and water flow headers; and (e) an access tower providing access to said vessel and supporting said water flow piping and headers, wherein said water flow piping and headers and the access tower are positioned about said vessel so as to provide an access corridor above the inner annular panel of the vessel for installation and removal of said inner annular panel.

10. A direct smelting plant as claimed in claim 9, wherein the corridor extends generally vertically upwards from the inner annular panel.

11. A direct smelting plant as claimed in claim 10, wherein the corridor has an outer boundary extending upwardly from the region of the outer periphery of the inner annular panel.

12. A direct smelting plant as claimed in claim 11, wherein said water flow headers are positioned on said access tower at a level above said inner annular panel and said water flow piping extends from said headers to couplings located on said vessel at levels below said inner annular panel.

13. A direct smelting plant as claimed in claim 11, wherein said inner annular panel is sized for insertion and removal of said cooling panels through the access opening created by removal of that panel.

14. A direct smelting plant as claimed in claim 12, wherein said inner annular panel has cooling panels on an internal surface and couplings on an external surface and wherein water flow piping for said cooling panels on said panel extend into said access corridor.

15. A direct smelting plant as claimed in claim 12, wherein said headers are located adjacent an external perimeter of said access tower and wherein said piping extends to couplings on said vessel via routes extending vertically downward and laterally across said access tower and which routes substantially avoid said access corridor.

16. A direct smelting plant as claimed in claim 8, wherein a gas injection lance extends through said central opening into the vessel and at least part of said injection lance is located in said access corridor.

17. A direct smelting plant as claimed in claim 16, wherein said central aperture and said injection lance are located coaxially with said access corridor.

18. A direct smelting plant as claimed in any one of claims 9 to 15, wherein said access tower comprises an access platform located above the top section of said vessel for providing access to said injection lance and having an aperture defining a portion of said access corridor.

19. A direct smelting apparatus as claimed in claim 18, wherein the injection lance extends through said aperture in said access platform.

20. A direct smelting plant as claimed in claim 18, wherein said injection lance is water cooled and comprises couplings for connection to supply pipes and wherein a portion of said supply pipes for said lance extend into said access corridor.

21. A direct smelting plant as claimed in claim 18 wherein the internal faces of the inner and outer annular panels conform to a curved surface extending from the upper end of the cylindrical section to the inner periphery of the inner panel.

22. A direct smelting plant as claimed in claim 21 wherein the inner faces of the inner and outer annular panels conform to a continuously curved dome.

23. A direct smelting plant as claimed in claim 18 wherein the inner and outer annular panels of the top section are provided with upstanding concentric annular flanges and are removably fastened to one another by clamping means effective to clamp those flanges together.

24. A direct smelting plant as claimed in claim 9 wherein the outer inwardly concavely curved annular panel is permanently fastened to the upper end of the continuous section by a continuous weld.

25. Direct smelting plant as claimed in claim 9 wherein the inner periphery of the inner annular panel is provided with an upstanding cylindrical part to receive the gas injection lance.

* * * * *